US010580552B2

(12) United States Patent
Gogola et al.

(10) Patent No.: US 10,580,552 B2
(45) Date of Patent: Mar. 3, 2020

(54) ELECTRIC POWER TRANSMISSION CABLES

(71) Applicant: NV Bekaert SA, Zwevegem (BE)

(72) Inventors: Peter Gogola, Trnava (SK); Peter Janssens, Zomergem (BE)

(73) Assignee: NV BEKAERT SA, Zwevegem (BE)

( * ) Notice: Subject to any disclaimer, the term of this patent is extended or adjusted under 35 U.S.C. 154(b) by 0 days.

(21) Appl. No.: 15/757,553

(22) PCT Filed: Nov. 8, 2016

(86) PCT No.: PCT/EP2016/076968

§ 371 (c)(1),
(2) Date: Mar. 5, 2018

(87) PCT Pub. No.: WO2017/080998

PCT Pub. Date: May 18, 2017

(65) Prior Publication Data

US 2018/0247736 A1 Aug. 30, 2018

(30) Foreign Application Priority Data

Nov. 10, 2015 (EP) ..... 15193788

(51) Int. Cl.
*H01R 4/00* (2006.01)
*H01B 7/22* (2006.01)
(Continued)

(52) U.S. Cl.
CPC ..... *H01B 7/225* (2013.01); *C23C 2/06* (2013.01); *C23C 2/28* (2013.01); *H01B 7/14* (2013.01); *H01B 7/22* (2013.01); *H01B 7/2806* (2013.01)

(58) Field of Classification Search
CPC ... H01B 7/02; H01B 7/04; H01B 7/14; H01B 7/225; H01B 7/22; H01B 7/02806; H01B 7/26; H01B 9/02; H01B 9/04; H01B 9/025
(Continued)

(56) References Cited

U.S. PATENT DOCUMENTS 2,886,631 A * 5/1959 Muller ..... H01B 7/226 174/108
9,136,040 B2 * 9/2015 Zettervall ..... H02G 1/14
(Continued)

FOREIGN PATENT DOCUMENTS

WO 2013/117270 8/2013
WO WO2013/11727 A1 * 8/2013 ..... C23C 2/38
WO 2014/202356 12/2014

*Primary Examiner* — William H. Mayo, III
(74) *Attorney, Agent, or Firm* — Wenderoth, Lind & Ponack, L.L.P.

(57) ABSTRACT

Electric power transmission cables containing a first portion provided with first armouring wires having a first tensile strength, the first armouring wires being made of a first metallic material coated with a first metallic protection coating with a thickness more than 100 g/m$^2$, the first metallic material having a first magnetic permeability μ1, a second portion provided with second armouring wires having a second tensile strength, the second armouring wires being made of a second metallic material coated with a second metallic protection coating with a thickness more than 100 g/m$^2$, the second metallic material having a second magnetic permeability μ2, and μ2≠μ1, the first armouring wires being longitudinally joined to the second armouring wires at a joint, the joint having a third tensile strength that is at least more than 80% of the lower tensile strength of the first tensile strength and the second tensile strength.

15 Claims, 1 Drawing Sheet

(51) Int. Cl.

| | |
|---|---|
| ***H01B 7/14*** | (2006.01) |
| ***C23C 2/06*** | (2006.01) |
| ***C23C 2/28*** | (2006.01) |
| ***H01B 7/28*** | (2006.01) |

(58) Field of Classification Search
USPC ..... 174/10, 110 R, 103, 106 R, 108, 109, 174/113 R
See application file for complete search history.

(56) References Cited

U.S. PATENT DOCUMENTS

| | | | | |
|---|---|---|---|---|
| 2001/0016103 | A1* | 8/2001 | Hoch | H01B 7/14<br>385/107 |
| 2012/0024565 | A1* | 2/2012 | Orini | H01B 7/14<br>174/106 R |
| 2015/0170795 | A1* | 6/2015 | Maioli | H01B 7/26<br>174/108 |

* cited by examiner

ELECTRIC POWER TRANSMISSION CABLES

TECHNICAL FIELD

The invention generally relates to the field of electric cables, i.e. cables for electric power transmission, in particular, alternate current (AC) power transmission, more particularly to submarine electric power transmission cables substantially intended to be deployed underwater.

BACKGROUND ART

Electricity is an essential part of modern life. Electric-power transmission is the bulk transfer of electrical energy, from generating power plants to electrical substations located near demand centres. Transmission lines mostly use high-voltage three-phase alternating current (AC). Electricity is transmitted at high voltages (110 kV or above) to reduce the energy lost in long-distance transmission. Power is usually transmitted through overhead power lines. Underground power transmission has a significantly higher cost and greater operational limitations but is sometimes used in urban areas or sensitive locations. Most recently, submarine power cables provide the possibility to supply power to small islands or offshore production platforms without their own electricity production. On the other hand, submarine power cables also provide the possibility to bring ashore electricity that was produced offshore (wind, wave, sea currents . . . ) to the mainland.

These power cables are normally steel wire armoured cables. A typical construction of steel wire armoured cable 10 is shown in FIG. 1. Conductor 12 is normally made of plain stranded copper. Insulation 14, such as made of cross-linked polyethylene (XLPE), has good water resistance and excellent insulating properties. Insulation 14 in cables ensures that conductors and other metal substances do not come into contact with each other. Bedding 16, such as made of polyvinyl chloride (PVC), is used to provide a protective boundary between inner and outer layers of the cable. Armour 18, such as made of steel wires, provides mechanical protection, especially provides protection against external impact. In addition, armouring wires 18 can relieve the tension during installation, and thus prevent copper conductors from elongating. Possible sheath 19, such as made of black PVC, holds all components of the cable together and provides additional protection from external stresses.

In use, submarine cables are generally installed under water, typically buried under the bottom ground or sea bed, but portions thereof may be laid in different environment; this is, for example, the case of shore ends of submarine links, intermediate islands crossing, contiguous land portions, edge of canals, transition from deep sea to harbor and similar situations. Associated with these environments, it is often a worse thermal characteristics and/or higher temperature with respect to the situation in the offshore or ashore main route.

The current rating, i.e. the amount of current that the cable can safely carry continuously or in accordance to a given load is an important parameter for an electric power cable. If the current rating is exceeded for a long time, the increase in temperature caused by the generated heat may damage the conductor insulation and cause permanent deterioration of electrical or mechanical properties of the cable. Therefore, the configuration of a power cable, e.g. the dimension of the core, is determined by the current rating. The current rating of a cable is dependent on the cable core size, the operational system parameters of the electric power distribution circuit, the type of insulation and materials used for all cable components and the installation condition and thermal characteristics of the surrounding environment.

In an AC power cable, the magnetic field generated by the current flowing in the conductors induces magnetic losses in ferromagnetic materials, or in a material having high magnetic permeability, such as in carbon steels used as armouring wires. The magnetic loss causes (or is transferred into) heat in the materials. Such an induced heat, added to the heat produced by the conductors due to the current transport, can limit the overall current carrying capacity of the power cable, especially when the power cable is deployed in environment with low or insufficient heat dissipation capability.

Solutions have been investigated to avoid a reduction in the electrical power transport capability of an electric cable due to heat generated by losses in the cable armouring.

One proposal is by increasing the size of the cable, particular of those cable sections which lay in the conditions of insufficient heat dissipation. However, such a solution is not desirable since it implies heavier and more expensive cables. A disadvantage of having a cable made of distinct sections of different size is that the cable continuity is impaired which is detrimental for the cable mechanical resistance, and it requires special transition joints between cable sections and requires careful handling during laying operation. In addition, these transition joints of the electric transmission cable may also generate additional electrical losses.

U.S. patent application publication No. 20120024565 discloses another solution to solve this problem. It discloses an electric power transmission cable comprising one first section provided with cable armour made of a first metallic material, and one second section provided with cable armour elements made of a second metallic material. The second metallic material is substantially free from ferromagnetism. The first and second sections are longitudinally contiguous with each other and an anticorrosion protection is provided in correspondence with a contact point between the armour elements in the first section and the armour elements in the second section. The anticorrosion protection comprises zinc rods or strips inserted in between the armour elements in the first section and the armour elements in the second section. According to this proposed solution, additional zinc rods or strips should be attached in the additional sleeve or belt joining the first section with the second section and thus the production of the power cable becomes complex and expensive.

DISCLOSURE OF INVENTION

It is a main object of the present invention to overcome the problems of the prior art.

It is another object of the present invention to provide an electrical power cable having a different heat generation abilities at different sections and can be produced with low cost.

It is still another object of the present invention to produce a composite wire made from different wires as an armouring structure for power cables. Such composite wire has sufficient tensile strength to fulfill the requirement for armouring power cables.

It is yet another object of the present invention to produce an armoured electric power transmission cable having more reliable corrosion performance than the known cables which comprise sections having different heat generation.

According to the first aspect of the present invention, it is provided an electric power transmission cable, comprising: at least a first portion provided with a plurality of first armouring wires having a first tensile strength, said plurality of first armouring wires being made of a first metallic material coated with a first metallic protection coating with a thickness more than 100 g/m$^2$, said first metallic material having a first magnetic permeability $\mu 1$, at least a second portion provided with a plurality of second armouring wires having a second tensile strength, said plurality of second armouring wires being made of a second metallic material coated with a second metallic protection coating with a thickness more than 100 g/m$^2$, said second metallic material having a second magnetic permeability $\mu 2$, and $\mu 2 \neq \mu 1$, each of said first armouring wires being longitudinally joined to one of said plurality of second armouring wires at a joint portion, said joint portion having a third tensile strength, wherein the third tensile strength is at least more than 80% of the lower tensile strength of the first tensile strength and the second tensile strength.

The electric power transmission cable according to the present invention can be a tri-phase submarine electric power transmission cable. Herewith, the power cables include high-voltage, medium-voltage as well as low-voltage cables. The common voltage levels used in medium to high voltage today, e.g. for in-field cabling of offshore wind farms, are 33 kV for in-field cabling and 150 kV for export cables. This may evolve towards 66 and 220 kV, respectively. The high-voltage power cables may also extend to 280, 320 or 380 kV if insulation technologies allow the construction. On the other hand, the power cables according to the invention can transmit electrical power having different frequencies. For instance, it may transmit the standard AC power transmission frequency, which is 50 Hz in Europe and 60 Hz in North and South America. Moreover, the power cable can also be applied in transmission systems that use 17 Hz, e.g. German railways, or still other frequencies.

The magnetic permeability $\mu 1$ of the first metallic material of first armouring wire is different from the magnetic permeability $\mu 2$ of the second metallic material. For instance, if $\mu 1 < \mu 2$, it indicates the magnetic loss of the first armouring wire is less than the magnetic loss of the second armouring wire when they armour the same AC power cable. Therefore, the first armouring wire generating less magnetic loss or heat and is more desirable to be used in the areas of insufficient heat dissipation. One of the first armouring wires is longitudinally joined with one of the second armouring wires. A plurality of first and the second armouring wires are individually and longitudinally joined to form a plurality of composite wires. A power cable armoured by such composite wires has a different heat generation at different portion. In the other word, such power cable can keep almost constant temperature in environments of different heat dissipation: by armoring the section with the first armouring wires in unfavorable heat dissipation environment, and armoring the section with the second armouring wires in favorable heat dissipation environment. Thus, there is no need to change other configurations to have the same or similar current rating throughout the power cable in the transmission.

The first and second armouring wires are individually joined. Therefore, the joined armouring wire or composite wire can be taken as a continuous wire in the production. Continuous wire normally means a uniform wire made from the same material and without interruptions like connection means. In contrast to the process as disclosed in U.S. patent application publication No. 20120024565, the production process of the power cable according to the present invention, in particular cabling and bunching process, will not be interrupted due to the joints. This avoids the complexity associated with the introduction of a separated joint sleeve or belt and additional anti-corrosion elements like zinc rods. On the other hand, thanks to the thick protection coating, the armoring wires according to the present invention are well protected from corrosion.

Importantly, the composite wires or joint portions made according to the present invention have a sufficient high tensile strength fulfilling the requirement for armouring power cables.

As an example, the first metallic material can be carbon steel and the second metallic material can be selected from austenitic steel, copper, bronze, brass, composite and alloys. Preferably, the austenitic steel is austenitic stainless steel which is non-magnetic.

According to the present invention, at least one of said plurality of first armouring wires is longitudinally joined to one of said plurality of second armouring wires by butt welded joints comprising resistive butt welding joints, flash butt welding joints and tungsten inert gas (TIG) welding joints. Preferably, the diameter of said plurality of first armouring wire is the same as the diameter of said plurality of second armouring wire. Thus formed composite wire looks like or can be taken as a continuous wire having a same diameter and they are easy to be cabled together as an armouring layer.

As an example, the first and second metallic protection coatings are selected from zinc, aluminum, zinc alloy or aluminum alloy. A zinc aluminum coating has a better overall corrosion resistance than zinc. In contrast with zinc, the zinc aluminum coating is more temperature resistant. Still in contrast with zinc, there is no flaking with the zinc aluminum alloy when exposed to high temperatures. A zinc aluminium coating may have an aluminium content ranging from 2 wt % to 23 wt %, e.g. ranging from 2 wt % to 12 wt %, or e.g. ranging from 5 wt % to 10 wt %. A preferable composition lies around the eutectoid position: aluminium about 5 wt %. The zinc alloy coating may further have a wetting agent such as lanthanum or cerium in an amount less than 0.1 wt % of the zinc alloy. The remainder of the coating is zinc and unavoidable impurities. Another preferable composition contains about 10 wt % aluminium. This increased amount of aluminium provides a better corrosion protection than the eutectoid composition with about 5 wt % of aluminium. Other elements such as silicon and magnesium may be added to the zinc aluminium coating. More preferably, with a view to optimizing the corrosion resistance, a particular good alloy comprises 2 wt % to 10 wt % aluminium and 0.2 wt % to 3.0 wt % magnesium, the remainder being zinc.

Preferably, the thickness of the first and second metallic protection coatings is in the range of 200 g/m$^2$ to 600 g/m$^2$. More preferably, said first and second metallic protection coatings are hot dipped zinc and/or zinc alloy coating. An intermediate layer of electroplated nickel, zinc or zinc alloy may be present between the first metallic material and hot dipped zinc and/or zinc alloy coating, and between the second metallic material and hot dipped zinc and/or zinc alloy coating. Alternatively, the wires after surface activation can be transferred under the protection of the tube filled with a heated reduction gas or gas mixture of argon, nitrogen and/or hydrogen to the galvanizing bath. These possible pre-treatments aim to block the activated surface from air or oxygen contamination, and thus avoid the occurrence of oxides on the activated surface. Therefore, these pre-treatments assist the surface of the metallic material to form a good adhesion with the later formed protection or corrosion resistant coating.

In order to insulate the joint portion completely from corrosion environment, the joint portion is preferably painted with a compound comprising same elements as for the first or second metallic protection coatings. The paint may be extended from the joint portions along the first and the second armouring wires in a length less than 20 cm, e.g. within 10 cm or 5 cm.

According to the second aspect of the present invention, it is provided a wire assembly or a composite wire, comprising at least a first portion provided with a first wire having a first tensile strength, said first wire being made of a first metallic material coated with a first metallic protection coating with a thickness more than 100 g/m$^2$, said first metallic material having a first magnetic permeability $\mu 1$, at least a second portion provided with a second wire having a second tensile strength, said second wire being made of a second metallic material coated with a second metallic protection coating with a thickness more than 100 g/m$^2$, said second metallic material having a second magnetic permeability $\mu 2$, and $\mu 2 \neq \mu 1$, said first wire and said second wire being longitudinally joined to each other at a joint portion, said joint portion having a third tensile strength, wherein the third tensile strength is at least more than 80% of the lower tensile strength of the first tensile strength and the second tensile strength.

A plurality of the composite wires can be wound around at least part of the power cable. Preferably, the power cable has at least an annular armouring layer made of said composite wires.

According to the third aspect of the present invention, it is provided a method for producing electric power transmission cables, comprising the steps of:

(a) providing a first armouring wire having two ends and a first tensile strength, said first armouring wires being made of a first metallic material coated with a first metallic protection coating having a thickness more than 100 g/m$^2$, said first metallic material having a first magnetic permeability $\mu 1$, (b) providing a second armouring wire having two ends and a second tensile strength, said second armouring wires being made of a second metallic material coated with a second metallic protection coating having a thickness more than 100 g/m$^2$, said second metallic material having a second magnetic permeability $\mu 2$, and $\mu 2 \neq \mu 1$, (c) removing said first metallic protection coating away from one end of said first armouring wires to form a first end with said first metallic material, (d) removing said second metallic protection coating away from one end of said second armouring wires to form a second end with said second metallic material, (e) joining said first end and second end to form a composite armouring wire so that said first armouring wire and second armouring wire are longitudinally joined to each other at a joint portion, said joint portions having a third tensile strength, wherein the third tensile strength is at least more than 80% of the first tensile strength and the second tensile strength, (f) painting said joint portion, said first end and said second end with a compound comprising same elements as for said first or second metallic protect coatings, (g) cabling a plurality of said composite armouring wires to provide at least a first portion for an electric power transmission cable with plurality of said first armouring wires and at least a second portion for said electric power transmission cable with plurality of said second armouring wires.

The metallic protection coating is removed prior to the first and the second armouring wires are joined. This step contributes to the high tensile strength of the joint portion. If the protection coating, e.g. zinc, is not removed, during joint operation, e.g. by welding, the segregation of zinc at the grain boundaries of first or second material will cause loss in tensile strength and ductility. The prior removal of metallic protection coating guarantees good mechanical properties.

The application of the wire assembly of the invention as armouring wires for submarine cables substantially prolongs the life time of the power cables because the heat generation due to magnetic loss of the power cable can be adjusted by armouring different types of wires. Simultaneously, the production of the power cable, in particular for armouring, according to the invention can still follow the same process as for armouring continuous wires. In addition, the dimension of the power cable would not be changed due to the composite wires. Therefore, the mechanical properties of the power cable would not be adversely affected. Moreover, the total cost of cable production according to the present invention is less than the production cost of other commonly known electric transmission power cables which comprise sections having different heat generation.

BRIEF DESCRIPTION OF FIGURES IN THE DRAWINGS

The invention will be better understood with reference to the detailed description when considered in conjunction with the non-limiting examples and the accompanying drawings, in which.

MODE(S) FOR CARRYING OUT THE INVENTION

Figure 1:
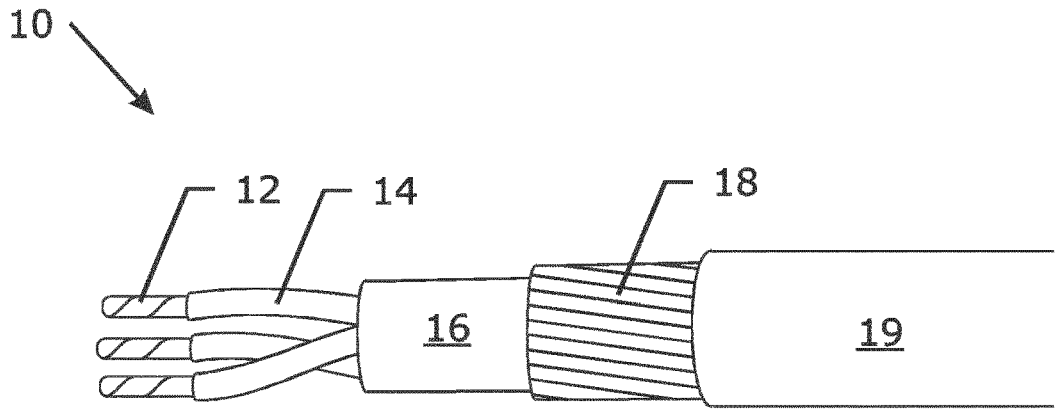
FIG. 1 shows a high voltage power cable according to prior art.
Figure 2:
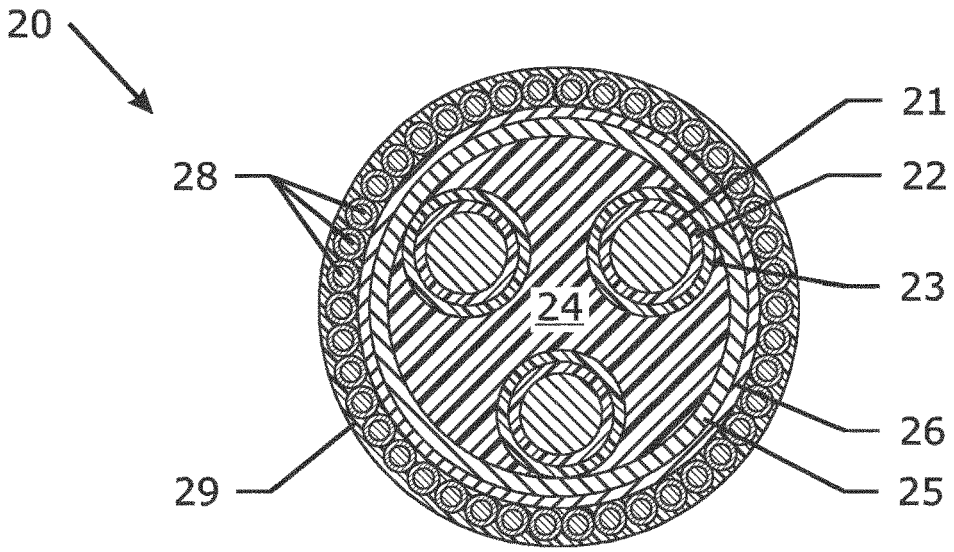
FIG. 2 illustrates a cross-section of a tri-phase power cable having armouring wires.

FIG. 2 represents a cross-section of a tri-phase submarine power cable armoured with the steel wires of present invention. It includes a compact stranded, bare copper conductor 21, followed by a conductor shield 22. An insulation shield 23 is applied to ensure that the conductor do not contact with each other. The insulated conductors are cabled together with fillers 24 by a binder tape, followed by a lead-alloy sheath 25. The lead-alloy sheath 25 is often needed due to the severe environmental demands placed on submarine cables. The sheath 25 is usually covered by an outer layer 26 comprising a polyethylene (PE) or polyvinyl chloride (PVC) jacket. This construction is armoured by steel wire armouring layer 28. According to the invention, the steel wires 28 used may be welded steel wires with an adherent galvanized layer for strong corrosion protection. An outer sheath 29, such as made of PVC or cross-linked polyethylene (XLPE) or a combination of PVC and XLPE layers, is preferably applied outside the armouring layer 28.

Figure 3:
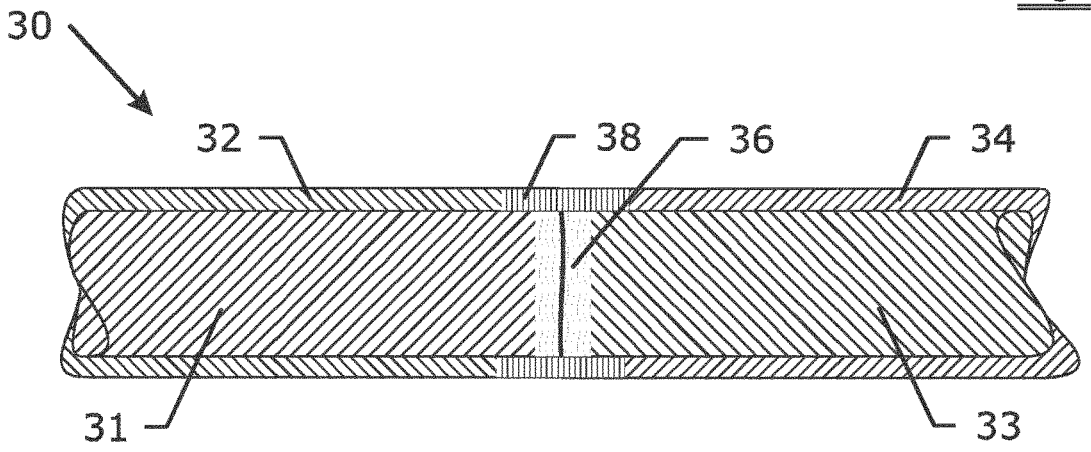
FIG. 3 illustrates a cross-section made along the longitudinal direction of the welded armouring wire according to the present invention.

FIG. 3 is a cross-section made along the longitudinal direction of the welded armouring wire 30. In the example, the welded armouring wire 30 comprises two types of wires, low carbon wire 31, e.g. low carbon steel grade 65 according to EN10257-2, and stainless steel wire 33, e.g. stainless steel grade AISI 302. Both wires are coated with corrosion protection coating, e.g. zinc 32, 34.

A steel wire, i.e. low carbon grade 65 or stainless grade AISI 302, e.g. having a diameter of 6 mm is first coated according to the following process.

This steel wire is first degreased in a degreasing bath (containing phosphoric acid) at 30° C. to 80° C. for a few seconds. An ultrasonic generator is provided in the bath to assist the degreasing. Alternatively, the steel wire may be first degreased in an alkaline degreasing bath (containing NaOH) at 30° C. to 80° C. for a few seconds.

This is followed by a pickling step, wherein the steel wire is dipped in a pickling bath (containing 100-500 g/l sulphuric acid) at 20° C. to 30° C. This is followed by another successive pickling carried out by dipping the steel wire in a pickling bath (containing 100-500 g/l sulphuric acid) at 20° C. to 30° C. for a short time to further remove the oxide on the surface of the steel wire. All pickling steps may be assisted by electric current to achieve sufficient activation.

After this second pickling step, the steel wire is immediately immersed in an electrolysis bath (containing 10-100 g/l zinc sulphate) at 20° C. to 40° C. for tens to hundreds of seconds. The steel wire is further treated in a fluxing bath. The temperature of fluxing bath is maintained between 50° C. and 90° C., preferably at 70° C. Afterward, the excess of flux is removed. The steel wire is subsequently dipped in a galvanizing bath maintained at temperature of 400° C. to 500° C.

Alternatively, after the second pickling process, the steel wire is rinsed in a flowing water rinsing bath. In this example, after the excess of water is removed, the wires are further transferred under the protection of the tube filled with a heated reduction gas or gas mixture of argon, nitrogen and/or hydrogen to the galvanizing bath. Preferably, the wires are heated to 400° C. to 900° C. in the tube before the galvanizing bath.

A zinc coating is formed on the surface of the stainless steel wire by galvanizing process. After hot-dip galvanizing tie- or jet-wiping, charcoal or magnetic wiping can be used to control the coating thickness. For instance, the thickness of the galvanized coating is ranging from 100 g/m$^2$ to 600 g/m$^2$, e.g. 200, 300 or 400 g/m$^2$. Then the wire is cooled down in air or preferably by the assistance of water. A continuous, uniform, void-free coating is formed.

In order to form the welded wire of the present invention, the coating of both coated low carbon steel wires and coated stainless steel wires are stripped at one end portion of the wires, e.g. from 5 mm to 5 cm from the end. The exposed low carbon steel wire and stainless steel wire having the same diameter are welded, e.g. by flash butt welding or by resistive butt welding. The welded zone 36 in between the two wires as shown in FIG. 3 is intended to be kept thin, e.g. from 0.5 mm to 1 cm and preferably from 0.5 mm to 2 mm. The welded zone at the outside surface of the welded wire is grinded and subsequently painted with zinc based enamels 38 as shown in FIG. 3.

Four types of wires are produced, tested and compared: type (I) low carbon steel wire standard grade 65, type (II) stainless steel wire standard grade AISI 302, type (III) welded wire and type (IV) welded wire which are both made by welding zinc coated type (I) wire and zinc coated type (II) wire. Type (III) welded wire is made by flash butt welding, while type (IV) welded wire is made by resistive butt welding.

Before welding, the zinc coating at the intended welding zone of type (I) wire and type (II) wire is removed by mechanical stripping. This intended welding zone is further treated by hydrochloric acid pickling before welding to avoid intergranular corrosion which may occur due to the segregation of impurities, e.g. zinc during and after welding.

The tensile strength or ultimate strength of the four types of wires is measured respectively. Tensile strength is the maximum stress that a material can withstand while being stretched or pulled before failing or breaking. The tensile strength is found by performing a tensile test. The two ends of a tested wire are griped respectively at two crossheads of the tensile test machine. The crossheads are adjusted for the length of the specimen and driven to apply tension to the test specimen. The diameter of the all four types of tested wires is the same, i.e. about 6 mm. For every test, the length of the wire between two crossheads is about 25 cm. The type (I) and type (II) wires are continuous wires, i.e. without welding or any connections means in-between. While for type (III) and type (IV) wires, the welded zone of two continuous parts are arranged approximately in the middle of two crossheads where the wire is fixed. The engineering stress versus strain is recorded during testing. The highest point of the stress-strain curve is the tensile strength. The applied maximum force, the tensile strength, yield strength, and the elongation at fracture of the four types of wires are summarized in table 1.

As shown in table 1, average tensile strength of type (I) wire is about 814 MPa, and the average tensile strength of type (II) wire is about 672 MPa which is lower than type (I). The average tensile strength of type (III) wire is 577 MPa, and the average tensile strength of type (IV) wire is 646 MPa, both being more than 80% of type (II) wire, which is 672×80%=537.6. It is also noted in the tensile testing that for type (III) wire, the broken point is at the welded zone. While for type (IV) wire, the broken point is located outside the welded zone and at type (II) wire section of the welded wire. These tests show the welded wires have a sufficient tensile strength to fulfill the requirement of armoring wires for power cables, in particular for type (IV) welded wire which performs even better than a continuous wire without welding.

In addition, the yield strength ($Rp_{P0.2}$) of the two types of welded wires is slightly higher than type (II) wire. The average elongation A (%) at fracture of type (III) and type (IV) wires is respectively 10% and 24%, which far exceeds 6% of the requirement for armouring wires.

TABLE 1

The diameter of the wires in mm, the applied maximum force F(N), the tensile strength $R_m$(MPa), the yield strength $R_{P0.2}$(MPa), and the elongation A (%) at fracture of the four types of wires are listed.

| No. | Sample | Dia. (mm) | F(N) | $R_m$(MPa) | $R_{P0.2}$(MPa) | A (%) |
|---|---|---|---|---|---|---|
| 1 | I | 6 | 23375 | 827 | 653 | 5 |
| 2 | I | 6 | 23147 | 819 | 661 | 6 |
| 3 | I | 6 | 22739 | 805 | 670 | 5 |
| 4 | I | 6 | 22789 | 806 | 638 | 5 |

TABLE 1-continued

The diameter of the wires in mm, the applied maximum force F(N), the tensile strength $R_m$(MPa), the yield strength $R_{P0.2}$(MPa), and the elongation A (%) at fracture of the four types of wires are listed.

| No. | Sample | Dia. (mm) | F(N) | $R_m$(MPa) | $R_{P0.2}$(MPa) | A (%) |
|---|---|---|---|---|---|---|
| 5 | I (Average) | 6 | 23013 | 814 | 656 | 6 |
| 6 | II | 6 | 18451 | 674 | 343 | 43 |
| 7 | II | 6 | 18383 | 672 | 347 | 43 |
| 8 | II | 6 | 18301 | 669 | 341 | 43 |
| 9 | II (Average) | 6 | 18378 | 672 | 344 | 43 |
| 10 | III | 6 | 15961 | 586 | 365 | 11 |
| 11 | III | 6 | 15462 | 568 | 365 | 10 |
| 12 | III (Average) | 6 | 15711 | 577 | 365 | 10 |
| 13 | IV | 6 | 17507 | 646 | 370 | 23 |
| 14 | IV | 6 | 17592 | 649 | 389 | 24 |
| 15 | IV | 6 | 17453 | 644 | 366 | 26 |
| 16 | IV | 6 | 17505 | 646 | 374 | 22 |
| 17 | IV (Average) | 6 | 17514 | 646 | 375 | 24 |

The invention claimed is:

1. An electric power transmission cable, comprising:

at least a first portion provided with a plurality of first armouring wires having a first tensile strength, said plurality of first armouring wires being made of a first metallic material coated with a first metallic protection coating with a thickness more than 100 g/m$^2$, said first metallic material having a first magnetic permeability μ1, at least a second portion provided with a plurality of second armouring wires having a second tensile strength, said plurality of second armouring wires being made of a second metallic material coated with a second metallic protection coating with a thickness more than 100 g/m$^2$, said second metallic material having a second magnetic permeability μ2, and μ2≠μ1, each of said plurality of first armouring wires being longitudinally and individually joined to one of said plurality of second armouring wires at a joint portion, said joint portion having a third tensile strength, wherein the third tensile strength is at least more than 80% of the lower tensile strength of the first tensile strength and the second tensile strength.

2. The electric power transmission cable according claim 1, wherein the electric power transmission cable is a tri-phase submarine electric power transmission cable.

3. The electric power transmission cable according to claim 1, wherein the first metallic material is carbon steel.

4. The electric power transmission cable according to claim 1, wherein the second metallic material is selected from austenitic steel, copper, bronze, brass, composite and alloys.

5. The electric power transmission cable according to claim 4, wherein the austenitic steel is austenitic stainless steel.

6. The electric power transmission cable according to claim 1, wherein at least one of said plurality of first armouring wires is longitudinally and individually joined to one of said plurality of second armouring wires by butt welded joint comprising resistive butt welding joint, flash butt welding joint and TIG welding joint.

7. The electric power transmission cable according to claim 1, wherein the diameter of said plurality of first armouring wire is the same as the diameter of said plurality of second armouring wire.

8. The electric power transmission cable according to claim 1, wherein the first and second metallic protection coatings are selected from zinc, aluminum, zinc alloy or aluminum alloy.

9. The electric power transmission cable according to claim 1, wherein the thickness of the first and second metallic protection coatings is in the range of 200 g/m$^2$ to 600 g/m$^2$.

10. The electric power transmission cable according to claim 1, wherein said first and second metallic protection coatings are hot dipped zinc and/or zinc alloy coating.

11. The electric power transmission cable according to claim 10, wherein said surface of the first metallic material and/or second metallic material are obtainable by a pre-treatment of electroplating with nickel, zinc and/or zinc alloy coating or being transferred under the protection of the tube filled with a heated reduction gas or gas mixture of argon, nitrogen and/or hydrogen to the galvanizing bath.

12. The electric power transmission cable according to claim 1, wherein the joint portion is painted with a compound comprising same elements as for the first or second metallic protection coatings.

13. The electric power transmission cable according claim 12, wherein the paint is extended from the joint portion along the first and the second armouring wires in a length less than 20 cm.

14. A composite wire, comprising:

at least a first portion provided with a first wire having a first tensile strength, said first wire being made of a first metallic material coated with a first metallic protection coating with a thickness more than 100 g/m$^2$, said first metallic material having a first magnetic permeability μ1, at least a second portion provided with a second wire having a second tensile strength, said second wire being made of a second metallic material coated with a second metallic protection coating with a thickness more than 100 g/m$^2$, said second metallic material having a second magnetic permeability μ2, and μ2≠μ1, said first wire and said second wire being longitudinally and individually joined to each other at a joint portion, said joint portion having a third tensile strength, wherein the third tensile strength is at least more than 80% of the lower tensile strength of the first tensile strength and the second tensile strength.

15. A method for producing electric power transmission cables, comprising the steps of:

(a) providing a first armouring wire having two ends and a first tensile strength, said first armouring wire being made of a first metallic material coated with a first metallic protection coating having a thickness more than 100 g/m$^2$, said first metallic material having a first magnetic permeability μ1, (b) providing a second armouring wire having two ends and a second tensile strength, said second armouring wire being made of a second metallic material coated with a second metallic protection coating having a thickness more than 100 g/m$^2$, said second metallic material having a second magnetic permeability μ2, and μ2≠μ1, (c) removing said first metallic protection coating away from one end of said first armouring wire to form a first end with said first metallic material, (d) removing said second metallic protection coating away from one end of said second armouring wire to form a second end with said second metallic material, (e) joining said first end and second end to form a composite armouring wire so that said first armouring wire and said second armouring wire are longitudinally and individually joined to each other at a joint portion, said joint portion having a third tensile strength, wherein the third tensile strength is at least more than 80% of the first tensile strength and the second tensile strength, (f) painting said joint portion, said first end and said second end with a compound comprising same elements as for said first or second metallic protect coatings, (g) cabling a plurality of said composite armouring wires to provide at least a first portion for an electric power transmission cable with plurality of said first armouring wires and at least a second portion for said electric power transmission cable with plurality of said second armouring wires.

* * * * *